US005257723A

United States Patent [19]

Bagung

[11] Patent Number: 5,257,723

[45] Date of Patent: Nov. 2, 1993

[54] BULK MELTER WITH MATERIAL RECIRCULATION

[75] Inventor: Jorg-Olaf Bagung, Deutsch Evern, Fed. Rep. of Germany

[73] Assignee: Nordson Corporation, Westlake, Ohio

[21] Appl. No.: 892,172

[22] Filed: Jun. 2, 1992

[51] Int. Cl.[5] ..... B67D 5/62

[52] U.S. Cl. ..... 222/1; 222/146.2; 222/146.5; 222/261; 222/318

[58] Field of Search ..... 222/387, 318, 260, 261, 222/326, 405, 146.2, 146.5, 333, 383, 258, 259; 219/241

[56] References Cited

U.S. PATENT DOCUMENTS

| | | | |
|---|---|---|---|
| 2,443,146 | 6/1948 | Pyles | 222/318 |
| 2,522,652 | 9/1950 | Von Haase | 222/146.5 X |
| 2,925,941 | 2/1960 | Bloxom | 222/261 X |
| 3,291,350 | 12/1966 | Malec | 222/318 |
| 3,964,645 | 6/1976 | Scholl | 222/146.5 |
| 4,059,714 | 11/1977 | Scholl et al. | 222/146.5 |
| 4,073,409 | 2/1978 | Gardner et al. | 222/146.5 |
| 4,200,207 | 4/1980 | Akers et al. | 222/318 X |
| 4,240,567 | 12/1980 | Gardner | 222/146.5 |
| 4,474,311 | 10/1984 | Petrecca | 222/146.5 |
| 4,592,491 | 6/1986 | Chollet | 222/146.5 |
| 4,632,277 | 12/1986 | Pallante | 222/146.2 |
| 4,667,850 | 5/1987 | Scholl et al. | 222/146.5 |
| 4,682,710 | 7/1987 | Turner, Jr. et al. | 222/146.2 |
| 4,771,920 | 9/1988 | Boccagno et al. | 222/146.5 |
| 4,790,455 | 12/1988 | Dieringer et al. | 222/146.2 |
| 4,821,922 | 4/1989 | Miller et al. | 222/146.2 |
| 4,850,514 | 7/1989 | Scholl et al. | 222/146.5 |

FOREIGN PATENT DOCUMENTS

| | | | |
|---|---|---|---|
| 3200470 | 2/1983 | Fed. Rep. of Germany . | |
| 0188786 | 11/1982 | Japan | 222/260 |

*Primary Examiner*—Andres Kashnikow
*Assistant Examiner*—Anthoula Pomrening
*Attorney, Agent, or Firm*—Wood, Herron & Evans

[57] ABSTRACT

A bulk melting and supplying apparatus comprises a platen assembly including a follower, a heating platen located beneath the follower and a pump which are insertable as a unit into the open top of a shipping barrel or drum in position so that the heating platen contacts and melts a portion of the solid thermoplastic material within the drum converting it to a molten state for delivery to the inlet of the pump. The outlet of the pump associated with the platen assembly is connected by a line to one or more thermoplastic dispensers or applicators, and structure is provided within the platen assembly to recirculate unused material from the dispensers or applicators back to the input side of the pump without exposing the material to atmosphere or otherwise causing degradation of such material.

12 Claims, 1 Drawing Sheet

BULK MELTER WITH MATERIAL RECIRCULATION

FIELD OF THE INVENTION

This invention relates to apparatus for melting and supplying solid thermoplastic material, and, more particularly, to a bulk melting device for melting solid thermoplastic material within a drum, pumping the thermoplastic material to one or more dispensers and recirculating unused material from the dispensers directly to the bulk melting device.

BACKGROUND OF THE INVENTION

Thermoplastic materials, such as hot melt thermoplastic adhesives, are conventionally stored and maintained in a solid state. When the material is to be used, it is melted and converted from a solid state to a molten state in a tank having heated walls. The melted material is maintained in the molten state within the tank and transmitted by a pump, as required, to one or more applicators or dispensers. If a particular application requires a substantial volume of hot melt thermoplastic material, a correspondingly large amount of material must be maintained in the molten or melted state within the tank and periodically replenished throughout a production run. Apparatus of this general type are disclosed, for example, in U.S. Pat. Nos. 3,964,645; 4,474,311; 4,667,850; 4,771,920; and, 4,821,922, all owned by the assignee of this invention.

Thermoplastic melting and dispensing apparatus of the type described above are effective in a number of applications, but can create environmental problems and degrade certain types of thermoplastic materials in some situations. A characteristic of most thermoplastic materials is that they oxidize, char or degrade when exposed to heat in the molten state over a prolonged length of time and/or when exposed to oxygen in the molten state. In relatively high throughput applications, and/or during a prolonged production run, the hoppers of apparatus of the type described above must be opened to allow additional solid thermoplastic material to be loaded therein as the quantity of material within the hopper becomes depleted. Removal of the top cover of the tank causes environmental problems since fumes or gaseous emissions are allowed to escape. In addition, the thermoplastic material within the tank is exposed to oxygen during the loading of additional material which can create charring or other degradation, particularly if a highly reactive thermoplastic material is employed.

One alternative to the tank or hopper-type melting and dispensing apparatus described above are bulk melter devices such as disclosed, for example, in U.S. Pat. Nos. 4,073,409; 4,240,567; and, 4,632,277, all owned by the assignee of this invention. Bulk melters of this type are designed for use with large, 55 gallon drums or barrels which contain thermoplastic material in the solid state. Such devices conventionally include a platen assembly comprising a follower, a heating platen located beneath the follower and a pump, all of which are insertable directly into the open top of the shipping drum. The heating platen is operable to melt the solid thermoplastic material in the region directly below the platen to convert that thermoplastic material into a liquid state for delivery to the pump. A seal is maintained between the follower of the platen assembly and the drum to prevent exposure of the thermoplastic material to atmosphere and to pressurize the contents of the drum. Because the contents of the shipping drum remain sealed until it is empty, escape of gaseous emissions and degradation caused by contact of the molten thermoplastic material with air are substantially eliminated.

One problem with bulk melters of the type described in the patents mentioned above is that they are not effective in applications where precise quantities of thermoplastic material must be supplied to applicators or dispensers. The pump associated with the platen assembly cannot be "dead-ended", i.e., the flow from the pump cannot be interrupted, which occurs, for example, when the thermoplastic dispensers or applicators are operated intermittently. As a result, bulk melters are typically used in combination with separate reservoirs or holding tanks wherein the molten thermoplastic material is transferred from the bulk melter to the holding tank, which, in turn, includes a pump to transmit the molten thermoplastic material to dispensers or applicators. While this arrangement reduces problems of degradation and charring of the thermoplastic material, the addition of a separate holding tank and pump for use with a bulk melter is relatively expensive and inefficient.

SUMMARY OF THE INVENTION

It is therefore among the objectives of this invention to provide an apparatus for melting and supplying thermoplastic material from bulk containers which avoids the escape of gaseous emissions from the molten thermoplastic material, which substantially eliminates degradation, charring or other damage to the thermoplastic material and which is capable of supplying precisely metered quantities of thermoplastic material to applicators or dispensers whether such dispensers are operated continuously or intermittently.

These objectives are accomplished in a bulk melting and supplying apparatus which comprises a platen assembly including a follower, a heating platen located beneath the follower and a pump. The platen assembly is insertable into the open top of a shipping barrel or drum in position so that the heating platen contacts and melts a portion of the solid thermoplastic material within the drum converting it to a molten state for delivery to the inlet of the pump. The outlet of the pump associated with the platen assembly is connected by a line to one or more thermoplastic dispensers or applicators, and structure is provided within the platen assembly to recirculate unused material from the dispensers or applicators back to the input side of the pump without exposing the material to atmosphere or otherwise causing degradation of such material.

In the presently preferred embodiment, the follower is formed with an inlet cavity which receives melted thermoplastic material through a bore in the heating platen. Because the platen assembly is forced downwardly within the drum or barrel, sufficient pressure is exerted on the molten thermoplastic material to urge it upwardly through the inlet cavity to the input of the pump associated with the platen assembly. The pump is operative to discharge the molten thermoplastic material from its output side through an outlet bore formed in the follower which is connected by a supply line to one or more applicators or dispensers.

In the presently preferred embodiment, the follower is also formed with a recirculation bore which is connected between the inlet cavity and a return line from the dispensers or applicators. In the event the thermoplastic material is not discharged by the dispensers, such as when they are operated intermittently, the unused material flows back through the return line into the recirculation bore of the follower which transmits such material to the inlet cavity on the input side of the pump. Preferably, a one-way valve is positioned in the return line to prevent air from flowing into the return line from the inlet cavity and recirculation bore.

In another aspect of this invention, the follower is formed with a bypass bore connected to the outlet of the pump, and a dump bore extending between the bypass bore and inlet cavity. A bypass valve is positioned at the juncture of the bypass bore and dump bore. The bypass valve is movable between a closed position in which it blocks flow from the bypass bore into the dump bore, and an open position wherein the bypass bore and dump bore are connected with one another. In the event of a blockage in the supply line or other problem which creates overpressurization at the output side of the pump, the bypass valve is movable to the open position to permit flow of thermoplastic material into the bypass bore, through the dump bore and then into the inlet cavity at the input side of the pump.

In a still further aspect of this invention, the recirculation bore is connected by a fitting to an air-bleed valve carried by the follower of the platen assembly. The air-bleed valve is effective to permit the escape of air which may be present within the top of the drum when the platen assembly is initially inserted therein, and/or any air which may enter the system during the pumping operation.

The drum melter of this invention therefore provides an essentially closed system for the transmission of molten thermoplastic material to one or more applicators or dispensers, thus avoiding the escape of gaseous emissions and degradation of molten adhesive which historically have presented problems in hopper or reservoir-type melting and dispensing apparatus. Additionally, the bulk melter of this invention can be utilized in applications where precise quantities of thermoplastic material must be supplied to applicators or dispensers because of the provision of structure to recirculate the material directly to the platen assembly of the bulk melter.

DESCRIPTION OF THE DRAWINGS

The structure, operation and advantages of the presently preferred embodiment of this invention will become further apparent upon consideration of the following description, taken in conjunction with the accompanying drawings, wherein.

DESCRIPTION OF THE INVENTION

Figure 1:
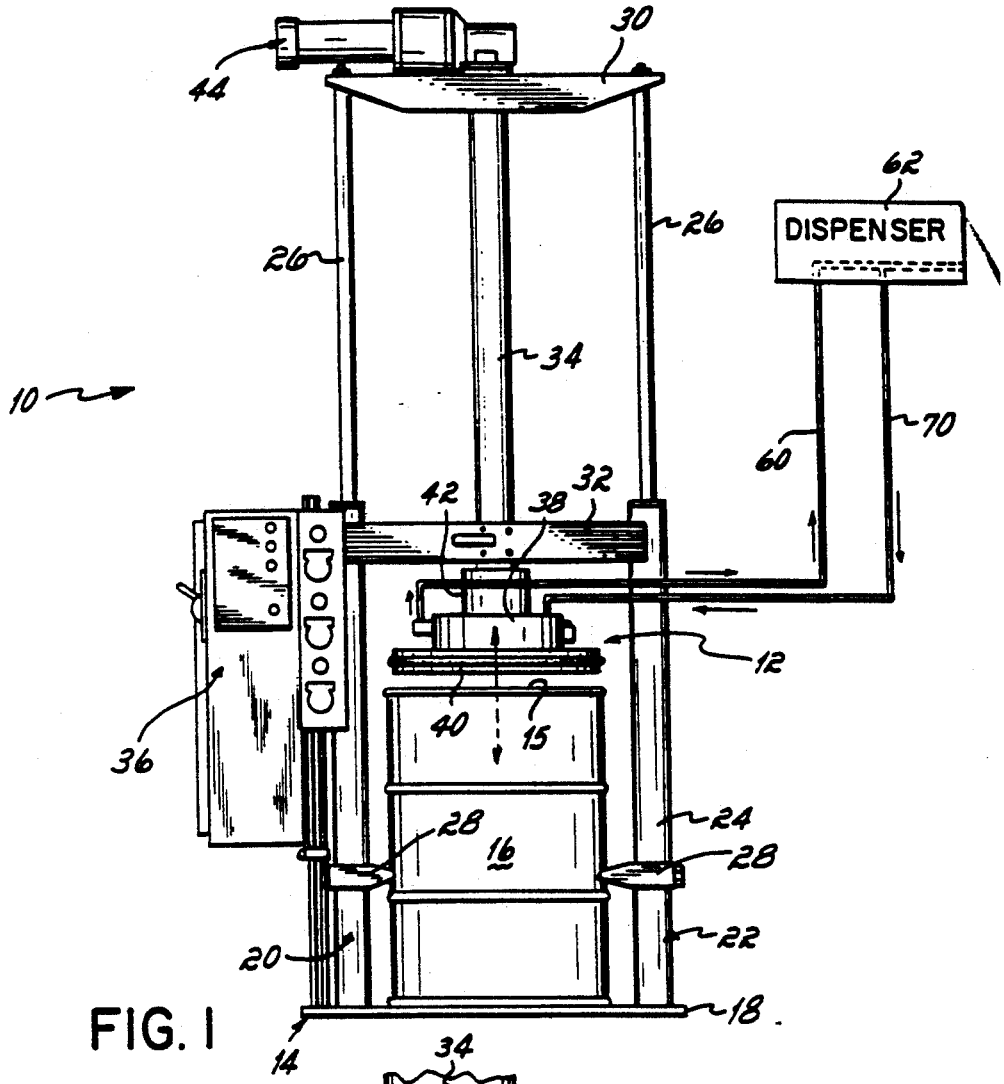
FIG. 1 is a side elevational view of a bulk melting and supplying apparatus according to this invention.

With reference to the FIGS., the melting and supplying apparatus 10 of this invention comprises a platen assembly 12 movable by a frame 14 relative to the open top 15 of a bulk container or drum 16. The drum 16 rests atop a base plate 18 of the frame 14 which, in turn, supports a pair of cylinders 20 and 22 extending vertically upwardly therefrom. For purposes of this discussion, the terms "upward" and "top" refer to the portion of apparatus 10 opposite the base plate 18 while the terms "lower" and "bottom" refer to the base portion of the frame 14 where base plate 18 is located.

Each of the cylinders 20, 22 includes a cylinder housing 24 within which a piston 26 is axially movable. As mentioned above, the drum 16 rests atop the base plate 18 of frame 14, and is preferably held in position thereon by a pair of hold-down mechanisms 28 each mounted to one of the cylinder housings 24. Hold-down mechanisms suitable for this purpose are disclosed in U.S. Pat. No. 4,632,277, owned by the assignee of this invention, the disclosure of which is incorporated by reference in its entirety herein.

The frame 14 also includes a top plate 30, an intermediate plate 32 connected between the cylinder housings 24, and, a support tube 34 which is fixed at one end to the top plate 30 and at the other end to the platen assembly 12. The piston 26 of each cylinder 20 and 22 is connected to the top plate 30 and are operative to reciprocate the top plate 30, and, in turn, the support tube 34 and platen assembly 12, relative to the drum 16. A control apparatus 36 is mounted to the frame 14 which includes the necessary electrical and air controls to operate the apparatus 10.

Figure 2:
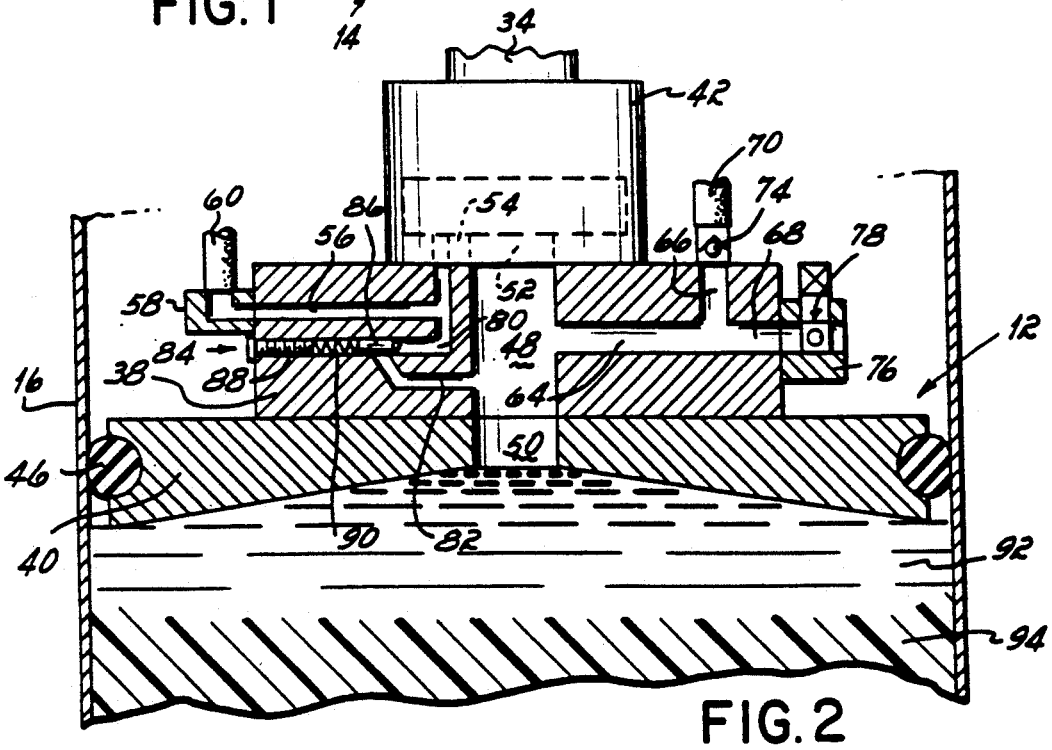
FIG. 2 is a cross sectional view of the platen assembly of this invention shown partially inserted within a barrel or drum containing thermoplastic material.

With reference to FIG. 2, the platen assembly 12 is illustrated in more detail. In the presently preferred embodiment, the platen assembly 12 comprises a follower 38, a heating platen 40 located beneath the follower 38, and, a pump 42 such as a gear pump which is located atop the follower 38. The pump 42 is driven by a motor 44 carried on the top plate 30. Preferably, the heating platen 40 has a concave lower surface, and a peripheral groove which receives a seal 46 engageable with the wall of the drum 16 when the platen assembly 12 is inserted within the drum 16 by operation of the cylinders 20, 22.

An important aspect of this invention is the provision of a recirculation capability within platen assembly 12. As shown in FIG. 2, the follower 38 of platen assembly 12 is formed with an inlet cavity 48 which is located between a bore 50 formed in the heating platen 40 and the inlet 52 of pump 42. As described in more detail below, molten thermoplastic material enters the inlet cavity 48 and is supplied to the inlet 52 of pump 42, which, in turn, discharges the thermoplastic material through its outlet 54. The outlet 54 of pump 42 is connected to an outlet bore 56 formed in the follower 38. A fitting 58, mounted to the follower 38 over the outer end of outlet bore 56, is connected to one end of a supply line 60 which transmits molten thermoplastic material to one or more applicators or dispensers 62 illustrated schematically in FIG. 1. The detailed construction of the dispenser 62 forms no part of this invention and is not discussed herein.

The follower 38 of platen assembly 12 is also formed with a recirculation bore 64 which is connected at one end to the inlet cavity 48 and then branches off to form a first leg 66 and a second leg 68 opposite the inlet cavity 48. The first leg 66 of recirculation bore 64 is connected to one end of a return line 70. The opposite end of return line 70 is connected to the dispenser 62, as schematically shown in FIG. 1. In the presently preferred embodiment, the return line 70 carries a one-way check valve 74 for purposes to become apparent below. The second leg 68 of recirculation bore 64 is connected by a fitting 76 to an air-bleed valve 78.

As shown in FIG. 2, the follower 38 is also formed with a bypass bore 80 communicating with the outlet 54 of pump 42, and a dump bore 82 connected between the bypass bore 80 and the inlet cavity 48. A bypass valve 84 is carried within the bypass bore 80, and this bypass valve 84 comprises a valve plug 86, a threaded stud 88 and a return spring 90 connected between the valve plug 86 and threaded stud 88. The threaded stud 88 is received within one end of the bypass bore 80 in position such that the valve plug 86 of bypass valve 84 is located at the intersection of bypass bore 80 and dump bore 82. In the closed position depicted in FIG. 2, the valve plug 86 of bypass valve 84 blocks the dump bore 82. In an open position, as discussed below, the valve plug 86 of bypass valve 84 moves to the left as viewed in FIG. 2 allowing material to flow from the bypass bore 80 into the dump bore 82.

METHOD OF OPERATION

The melting and supplying apparatus 10 of this invention operates as follows. Initially, the cylinders 20 and 22 are actuated to move the pistons 26 thereof vertically downwardly within the cylinder housings 24. In response to such motion of the pistons 26, the top plate 30, support tube 34 and platen assembly 12 all move downwardly as a unit toward the open top 15 of drum 16. The platen assembly 12 enters the drum 16 with the seal 46 carried by the heating platen 40 sealingly engaging the wall of drum 16. The heating platen 40 is effective to heat the thermoplastic material within the drum 16 forming a portion or layer of molten thermoplastic material 92 at the top portion of the drum 16 above the remaining, solid thermoplastic material 94 therein. Because the platen assembly 12 is forced downwardly within the drum 16 by operation of the cylinders 20, 22, the molten thermoplastic material 92 is pressurized and forced vertically upwardly through the platen bore 50, and inlet cavity 48 into the inlet 52 of the pump 42.

The pump 42 is operated by motor 44 to discharge the molten thermoplastic material from its outlet 54 into the outlet bore 56 formed in the follower 38. The thermoplastic material is transmitted through the supply line 60 to the dispenser 62 for deposit onto a substrate. In the event the dispenser 62 is not operating, such as in applications which require intermittent supply of thermoplastic material, all or a portion of the thermoplastic material supplied to the dispenser 62 is directed into the return line 70 and flows back to the platen assembly 12. The one-way, check valve 74 located in the return line 70 ensures that the recirculated thermoplastic material flows into the recirculation bore 64 from the return line 70 and prevents the flow of air in the opposite direction into the return line 70. The recirculated, molten thermoplastic material is thus delivered through the check valve 74 and recirculation bore 64 back into the inlet cavity 48 in position to enter the inlet 52 of pump 42 for supply to the dispenser 62.

Two other aspects of the construction of platen assembly 12 provide advantages in the operation of apparatus 10. With reference to the righthand portion of platen assembly 12 depicted in FIG. 2, as mentioned above, the follower 38 of platen assembly 12 includes an air-bleed valve 78 connected by fitting 76 to the second leg 68 of recirculation bore 64. It is contemplated that during the initial insertion of the platen assembly 12 into the open top 15 of drum 16, at least some air would be entrapped between the heating platen 40 and the surface of the thermoplastic material within the drum 16. The air-bleed valve 78 is effective to bleed off or remove such air from inside of the drum 16 to prevent its contact with the thermoplastic material as it is being melted, which, as discussed above, could cause degradation or charring of such material. Additionally, the air-bleed valve 78 is effective to bleed off any other air which may be introduced into the system during operation, e.g., due to leakage at the fittings 58, 76, at the seal 46 or at any other place within the system.

The platen assembly 12 is also provided with an emergency bypass at the output side of the pump 42 to prevent overpressurization in the event of a blockage, for example, in the supply line 60 or dispenser 62. As mentioned above, the follower 38 is formed with a bypass bore 80 communicating with the pump outlet 54, which, in turn, is connected to a dump bore 82. Under normal operating conditions, molten thermoplastic material discharged from the pump outlet 54 flows into the outlet bore 56 and bypass bore 80 but is prevented from entering the dump bore 82 by the bypass valve 84. The return spring 90 of bypass valve 84 exerts a sufficient force on the valve plug 86 to maintain it in a closed position relative to the inlet of the dump bore 82 when the pressure at the output side of the pump 42 is within normal operating ranges. In the event of a blockage of supply line 60, for example, the pressure within the outlet bore 56 and bypass bore 80 can increase to a level which forces the valve plug 86 of bypass valve 84 to an open position against the spring force of return spring 90. With the bypass valve 84 in an open position, a flow path is created from the bypass bore 80 through the dump bore 82 and into the inlet cavity 48. As a result, the thermoplastic material is circulated between the inlet 52 and outlet 54 of the pump 42 via the bypass bore 80, dump bore 82 and inlet cavity 48. This prevents damage to the pump 42 and overpressurization within the platen assembly 12.

While the invention has been described with reference to a preferred embodiment, it will be understood by those skilled in the art that various changes may be made and equivalents may be substituted for elements thereof without departing from the scope of this invention. In addition, many modifications may be made to adapt a particular situation or material to the teachings of the invention without departing from the essential scope thereof.

For example, the heating platen 40 is shown with a concave lower surface but it should be understood that other configurations could be utilized depending on the application. Therefore, it is intended that the invention not be limited to the particular embodiment disclosed as the best mode contemplated for carrying out this invention, but that the invention will include all embodiments falling within the scope of the appended claims.

I claim:

1. Apparatus for melting and supplying solid thermoplastic material from a bulk container to at least one thermoplastic dispenser, comprising:

a platen assembly including a follower, a heating platen carried by said follower and a pump having an inlet and a discharge outlet;

means for providing relative movement between said platen assembly and the bulk container filled with solid thermoplastic material, said heating platen being effective to melt at least a portion of the solid thermoplastic material within the bulk container;

said platen assembly being formed with an inlet cavity which communicates with said inlet of said pump, an outlet passage connected to said outlet of said pump and a recirculation bore connected to said inlet cavity, the thermoplastic material melted by said heating platen being forced through said inlet cavity into said inlet of said pump and discharged from said outlet thereof into said outlet passage;

said outlet passage of said platen assembly being adapted to be connected to the dispenser for supplying thermoplastic material thereto, and said recirculation bore of said platen assembly being adapted to be connected to the dispenser for receiving unused thermoplastic material therefrom;

valve means for permitting a one-way flow of unused thermoplastic material from the dispenser through said recirculation bore and into said inlet cavity of said platen assembly.

2. The apparatus of claim 1 in which said valve means is a one-way valve located in a line connected between said recirculation bore and the dispenser.

3. The apparatus of claim 1 in which said platen assembly is formed with a bypass bore connected to said outlet passage, and a dump bore connected between said bypass bore and said inlet cavity, said bypass bore carrying a bypass valve which is movable between a closed position wherein flow of thermoplastic material into said dump bore is blocked and an open position wherein flow of thermoplastic material is permitted through said dump bore and into said inlet cavity.

4. The apparatus of claim 1 in which said platen assembly includes an air exhaust valve operatively connected to said recirculation bore, said air exhaust valve being effective to vent air from said platen assembly.

5. Apparatus for melting and supplying solid thermoplastic material from a bulk container to at least one thermoplastic dispenser, comprising:

a platen assembly including a follower, a heating platen carried by said follower and a pump having an inlet and a discharge outlet;

means for providing relative movement between said platen assembly and the bulk container filled with solid thermoplastic material, said heating platen being effective to contact and melt at least a portion of the solid thermoplastic material within the bulk container, said platen assembly being formed with:

(i) an inlet cavity extending between said inlet of said pump and a platen bore formed in said heating platen, the molten thermoplastic material melted by said heating platen being forced into said inlet cavity through said platen bore and to said inlet of said pump;

(ii) an outlet bore connected at one end to said outlet of said pump, the other end of said outlet bore being adapted to connect to a supply line leading to the dispenser for supplying molten thermoplastic material thereto;

(iii) a recirculation bore connected at one end to said inlet cavity, the other end of said recirculation bore being adapted to be connected to a return line from the dispenser to receive unused molten thermoplastic material therefrom;

(iv) a bypass bore connected to said outlet bore; and (v) a dump bore connected between said bypass bore and said inlet cavity;

first valve means for permitting a one-way flow of unused thermoplastic material from the dispenser through said recirculation bore and into said inlet cavity; and second valve means, carried by said bypass bore, for blocking flow of material from said bypass bore into said dump bore in a closed position and for permitting flow of material from said bypass bore into said dump bore in an open position.

6. The apparatus of claim 5 in which said platen assembly includes an air exhaust valve operatively connected to said recirculation bore, said air exhaust valve being effective to vent air from said platen assembly.

7. Apparatus for melting and supplying solid thermoplastic material from a bulk container to at least one thermoplastic dispenser, comprising:

a platen assembly including a follower, a heating platen carried by said follower and a pump having an inlet and a discharge outlet;

said heating platen being adapted to melt at least a portion of the solid thermoplastic material within the interior of the bulk container;

said platen assembly being formed with an inlet cavity which communicates with said inlet of said pump, an outlet passage connected to said outlet of said pump and a recirculation bore connected to said inlet cavity, the thermoplastic material melted by said heating platen being forced through said inlet cavity into said inlet of said pump and discharged from said outlet thereof into said outlet passage;

said outlet passage of said platen assembly being adapted to be connected to the dispenser for supplying thermoplastic material thereto, and said recirculation bore of said platen assembly being adapted to be connected to the dispenser for receiving unused thermoplastic material therefrom;

valve means for permitting a one-way flow of unused thermoplastic material from the dispenser through said recirculation bore and into said inlet cavity of said platen assembly.

8. The apparatus of claim 7 in which said valve means is a one-way valve located in a line connected between said recirculation bore and the dispenser.

9. The apparatus of claim 7 in which said platen assembly is formed with a bypass bore connected to said outlet passage, and a dump bore connected between said bypass bore and said inlet cavity, said bypass bore carrying a bypass valve which is movable between a closed position wherein flow of thermoplastic material into said dump bore is blocked and an open position wherein flow of thermoplastic material is permitted through said dump bore and into said inlet cavity.

10. The apparatus of claim 7 in which said platen assembly includes an air exhaust valve operatively connected to said recirculation bore, said air exhaust valve being effective to vent air from said platen assembly.

11. The method of melting and supplying molten thermoplastic material from a bulk container to at least one thermoplastic dispensing device, comprising:

melting solid thermoplastic material within a bulk container by operation of a heating platen of a platen assembly located inside of the bulk container in sealing engagement with the container wall;

pumping the molten thermoplastic material from the bulk container to one or more dispensing devices;

recirculating unused thermoplastic material from at least one thermoplastic dispensing device to the platen assembly in preparation for pumping back to the said at least one thermoplastic dispensing device.

12. The method of claim 11 in which said step of recirculating unused thermoplastic material comprises directing the unused thermoplastic material from at least one thermoplastic dispensing device through a return line carrying a valve means which permits a one-way flow of the thermoplastic material into the platen assembly from the said at least one thermoplastic dispensing device.

* * * * *